United States Patent [19]

Kud et al.

[11] Patent Number: 4,746,456

[45] Date of Patent: May 24, 1988

[54] DETERGENTS CONTAINING GRAFT COPOLYMERS OF POLYALKYLENE OXIDES AND VINYL ACETATE AS ANTIREDEPOSITION INHIBITORS

[75] Inventors: Alexander Kud, Eppelsheim; Guenther Schulz; Wolfgang Trieselt, both of Ludwigshafen; Heinrich Hartmann, Limburgerhof, all of Fed. Rep. of Germany

[73] Assignee: Basf Aktiengesellschaft, Ludwigshafen, Fed. Rep. of Germany

[21] Appl. No.: 914,267

[22] Filed: Oct. 2, 1986

[30] Foreign Application Priority Data

Oct. 12, 1985 [DE] Fed. Rep. of Germany ..... 3536530

[51] Int. Cl.[4] ..... C11D 3/37

[52] U.S. Cl. ..... 252/174.24; 252/95; 252/99; 252/135; 252/174.23; 252/DIG. 2; 252/DIG. 15

[58] Field of Search ..... 252/174.23, 174.24, 252/DIG. 2, DIG. 15, 95, 99

[56] References Cited

U.S. PATENT DOCUMENTS

| | | | |
|---|---|---|---|
| 2,755,252 | 7/1956 | Fong et al. | 252/174.23 |
| 3,284,364 | 11/1966 | Siegele | 252/132 |
| 4,068,035 | 1/1978 | Violland et al. | 428/279 |
| 4,088,610 | 5/1978 | Bevan et al. | 252/541 |
| 4,444,561 | 4/1984 | Denzinger et al. | 252/174.24 |
| 4,490,271 | 12/1984 | Spadini et al. | 252/174.23 |

FOREIGN PATENT DOCUMENTS

| | | |
|---|---|---|
| 1077430 | 3/1960 | Fed. Rep. of Germany . |
| 119902 | 11/1974 | Japan . |
| 922457 | 4/1963 | United Kingdom . |

*Primary Examiner*—Prince E. Willis

*Attorney, Agent, or Firm*—Oblon, Fisher, Spivak, McClelland & Maier

[57] ABSTRACT

Detergents contain added graft copolymers which have an antiredeposition action and are obtainable by grafting polyalkylene oxides having a number average molecular weight of from 2000 to 100,000 with vinyl acetate in a weight ratio of from 1:0.2 to 1:10, and up to 15% of whose acetate groups may be hydrolyzed.

15 Claims, No Drawings

DETERGENTS CONTAINING GRAFT COPOLYMERS OF POLYALKYLENE OXIDES AND VINYL ACETATE AS ANTIREDEPOSITION INHIBITORS

In many countries, legislation has made it necessary greatly to reduce the content of phosphates in detergents or to provide phosphate-free detergents. However, if the content of phosphates in detergents is reduced, the washing action of the products is impaired. Phosphates act not only as sequestering agents for alkaline earth metal ions but also as encrustation inhibitors and antiredeposition agents. While the problem of encrustation, ie. deposits of mineral origin on the material to be washed, can be coped with by replacing the phosphates in detergents with other substances, this method is unsatisfactory for dealing with the problem of redeposition, ie. resoiling of the material being washed by particles of dirt and fats during washing. The problem of redeposition occurs especially in the case of fabrics containing synthetic fibers, in particular with polyester-containing textiles.

European Pat. No. 87,671 discloses the use of copolymers which contain, as copolymerized monomer units, (a) from 50 to 90% by weight of one or more vinyl esters of aliphatic carboxylic acids of 1 to 4 carbon atoms, (b) from 5 to 35% by weight of one or more N-vinyllactams, (c) from 1 to 20% by weight of one or more monomers containing basic groups, or their salts or quaternization products, and (d) from 0 to 20% by weight of one or more other monomers which are copolymerizable with the monomers (a), (b) and (c) and are free of carboxyl groups and basic groups, with the proviso that the percentages sum to 100, as antiredeposition agents in the washing and aftertreatment of goods containing synthetic fibers.

It is an object of the present invention to provide antiredeposition agents for detergents and antiredeposition agents for the aftertreatment of goods containing synthetic fibers. We have found that this object is achieved, in accordance with the invention, by the use of graft copolymers which are obtainable by grafting (a) a polyalkylene oxide which has a number average molecular weight of from 2000 to 100,000 and is based on ethylene oxide, propylene oxide and/or butylene oxide with (b) vinyl acetate in a weight ratio (a):(b) of from 1:0.2 to 1:10, and up to 15% of whose acetate groups may be hydrolyzed, as antiredeposition agents in the washing and aftertreatment of goods containing synthetic fibers.

The products used according to the invention are known (cf. German Pat. No. 1,077,430). They are obtainable by grafting polyalkylene oxides with vinyl acetate, the graft copolymerization being initiated by free radicals. For this purpose, it is possible either to use conventional polymerization initiators which decompose into free radicals under the polymerization conditions or to initiate the polymerization by high energy radiation. Suitable polyalkylene oxides are polymers which are based on ethylene oxide, propylene oxide and/or butylene oxide and have a number average molecular weight of from 2000 to 100,000, preferably from 4000 to 50,000. The alkylene oxide units can be randomly distributed in the polymer or may be present in the form of blocks, examples of such polymers being block copolymers of ethylene oxide and propylene oxide, of ethylene oxide and butylene oxide and of ethylene oxide, propylene oxide and butylene oxide.

One method of preparing the graft copolymers is to dissolve suitable polyalkylene oxides in vinyl acetate, add a polymerization initiator and carry out the polymerization continuously or batchwise. Another possible procedure is a semicontinuous one in which some, eg. 10%, of the mixture to be polymerized, and consisting of polyalkylene oxide, vinyl acetate and initiator, is initially taken and heated to polymerization temperature and, after the polymerization has begun, the remainder of the mixture to be polymerized is added as the polymerization proceeds. The graft copolymers can also be obtained if the polyalkylene oxide is initially taken and heated to the polymerization temperature, and vinyl acetate and the initiator are added all at once, in batches or preferably continuously.

Particularly suitable polymerization initiators are organic peroxides, such as diacetyl peroxide, dibenzoyl peroxide, succinyl peroxide, di-tert-butyl peroxide, tert-butyl perbenzoate, tert-butyl perpivalate, tert-butyl permaleate, cumene hydroperoxide, diisopropyl peroxydicarbonate, bis-(o-toluoyl) peroxide, didecanoyl peroxide, dioctanoyl peroxide, dilauroyl peroxide, tert-butyl perisobutyrate, tert-butyl peracetate, di-tert-amyl peroxide or tert-butyl hydroperoxide, and mixtures of initiators. The graft copolymerization can be carried out at from 50° to 200° C. but is preferably effected at from 70° to 140° C. It may furthermore be carried out under superatmospheric pressure. The graft copolymerization can be carried out in a solvent, by the solution polymerization method. Examples of suitable solvents are alcohols, such as methanol, ethanol, n-propanol, isopropanol, n-butanol, sec-butanol, tert-butanol, n-hexanol and cyclohexanol, glycols, such as propylene glycol, ethylene glycol and butylene glycol, the methyl and ethyl ethers of the dihydric alcohols, and dioxane. The graft copolymerization is preferably carried out in the presence of water as a solvent. Where water is used as a solvent, the solution initially obtained is converted to a dispersion, depending on the amount of vinyl acetate added. In this method of preparation, it is also possible to use an emulsifier.

From 5 to 100, preferably from 10 to 50, parts by weight of a solvent or of a solvent mixture, for example a mixture of isopropanol and water or of ethylene glycol and ethanol, are used per 100 parts by weight of the graft copolymer or polyalkylene oxide and vinyl acetate.

The weight ratio of polyalkylene oxide to vinyl acetate in the graft copolymer is from 1:0.2 to 1:10, preferably from 1:0.5 to 1:6. Polyethylene oxide having a number average molecular weight of from 2000 to 100,000, in particular from 4000 to 50,000, is preferably used as the grafting base. Up to 15% of the acetate groups of the graft copolymer may be hydrolyzed. Hydrolysis of the graft copolymers, which leads to graft copolymers containing vinyl alcohol units, is carried out by adding a base, such as NaOH or KOH, or an acid, and, if required, heating the mixture. The graft copolymers used according to the invention as antiredeposition agents have a K value according to H. Fikentscher of from 10 to 200, preferably from 20 to 100 (determined in a 1% strength by weight solution in ethyl acetate at 25° C.).

The graft copolymers described above are used in detergents having a reduced phosphate content (ie. a phosphate content corresponding to less than 25% by weight of sodium triphosphate) or in phosphate-free detergents. The graft copolymers used according to the invention are added to commercial detergent mixtures in an amount of from 0.1 to 3, preferably from 0.3 to 2, % by weight, based on the detergent mixture. The said copolymers can be added to the detergent formulation in the form of a paste, a highly viscous mass or a solution in a solvent. The products may also be adsorbed onto the surface of standardizing agents, eg. $Na_2SO_4$, builders (zeolites) or solid auxiliaries in the detergent formulation. It is also possible to add the products in finely divided form to the detergent formulation.

The commercial detergents contain not only phosphates (as builders) but also surfactants, for example $C_8$–$C_{12}$-alkylphenol oxyethylates, $C_{12}$–$C_{20}$-alkanol oxyethylates, block copolymers of ethylene oxide and propylene oxide which may or may not have blocked terminal groups, anionic surfactants, such as $C_8$–$C_{12}$-alkylbenzenesulfonates, $C_{12}$–$C_{16}$-alkanesulfonates, $C_{12}$–$C_{16}$-alkylsulfates, $C_{12}$–$C_{16}$-alkylsulfosuccinates or sulfated oxyethylated $C_{12}/C_{16}$-alkanols, and may furthermore contain from 0.5 to 3% by weight of an encrustation inhibitor, such as polymaleic acid, maleic acid/acrylic acid copolymers, polyacrylic acid or its salts, as well as phosphate substitutes, such as zeolites, in an amount of from 5 to 30% by weight, from 3 to 25% by weight of a bleach, such as sodium perborate, and if required bleach activators, from 10 to 30% by weight of standardizing agents, such as sodium sulfate, soaps, alkalis, such as sodium carbonate, softeners and antifoams, perfume, optical brighteners and, if desired, enzymes.

The graft copolymers are also useful as additives in the aftertreatment of goods containing synthetic fibers. For this purpose, they are added to the final rinse of a washing machine cycle, either together with a softener usually employed at this point or, if a softener is not desired, alone in place of the softener. The amounts used are from 0.01 to 0.3 g/l of wash liquor. Using the graft copolymers in the final rinse of a washing machine cycle has the advantage that, in the next washing cycle, the goods being washed are soiled to a much smaller extent than when no antiredeposition agent is added.

In the Examples, parts and percentages are by weight. The K values of the graft copolymers were measured according to H. Fikentscher, Cellulose Chemie 3 (1932), 58–64 and 71–74, in 1% strength solution in ethyl acetate at 25° C.; $K=k.10^3$. The number average molecular weights of the polyetherdiols used were calculated from the OH number.

The following products were used:

Graft copolymers 1 to 13

The graft copolymers were prepared according to German Pat. No. 1,077,430 by grafting the number of parts of vinyl acetate stated in Table 1 onto, in each case, 100 parts of a polyethylene oxide having the number average molecular weight likewise stated in this table. The K values of the graft copolymers are also given in Table 1.

TABLE 1

| Graft copolymer | Number of parts of vinyl acetate | $\overline{M}_n$ for the polyethylene oxides used | K value of the graft copolymers |
|---|---|---|---|
| 1 | 60 | 35,000 | 42.2 |
| 2 | 120 | 35,000 | 41.6 |
| 3 | 200 | 35,000 | 50.1 |
| 4 | 200 | 9,000 | 41.0 |
| 5 | 250 | 9,000 | 42.4 |

TABLE 1-continued

| Graft copolymer | Number of parts of vinyl acetate | $\overline{M}_n$ for the polyethylene oxides used | K value of the graft copolymers |
|---|---|---|---|
| 6 | 275 | 9,000 | 41.4 |
| 7 | 300 | 9,000 | 42.6 |
| 8 | 100 | 4,000 | 21.9 |
| 9 | 200 | 4,000 | 23.9 |
| 10 | 300 | 4,000 | 26.8 |
| 11 | 100 | 1,500 | 15.6 |
| 12 | 200 | 1,500 | 18.3 |
| 13 | 300 | 1,500 | 21.2 |

Graft copolymer 14

This graft copolymer was prepared by complete hydrolysis of graft copolymer 4 with NaOH.

The antiredeposition action of the above graft copolymers was tested as follows:

A polyester test fabric and a polyester/cotton blend were subjected to a series of 3 washes, together with a standard soiled fabric. The soiled fabric was replaced by a new one after each wash, the test fabric becoming more soiled after each wash. The whiteness of the test fabric after the third wash was used to assess the degree of soiling, the values being confirmed by repeating the procedure several times and calculating the mean value. It was measured as % reflectance, using an Elrepho apparatus from Zeiss with filter 8.

| Test conditions | |
|---|---|
| Test apparatus: | Launder-O-meter |
| Hardness of water: | 3.5 μmol of Ca/l, Ca:Mg = 3:2 |
| Amount of liquor: | 250 ml |
| Liquor ratio: | 1:10 |
| Test temperature: | 35–60° C. |
| Duration of test: | 30 minutes (including heating up time) |
| Detergent concentration: | 8 g/l |

In the Examples, the antiredeposition agent was added in an amount of 0.5%, based on the test detergent. The test vessels each contained 15 g of test fabric (5 g of polyester fabric, 5 g of polyester/cotton blend and 5 g of cotton fabric) and 10 g of soiled fabric. The soiled fabric used was a cotton soiled fabric from the Waschereiforschungsanstalt Krefeld, ie. WFK 10D.

The detergent used had the following composition:

| | |
|---|---|
| $C_{12}$-alkylbenzenesulfonate | 6.25% |
| Tallow fatty alcohol reacted with 11 moles of ethylene oxide | 4.7% |
| Soap | 2.8% |
| Na triphosphate (90% conservation) | 20% |
| Na perborate (tetrahydrate) | 20% |
| $Na_2SO_4$ | 24% |
| Sodium disilicate | 6% |
| Mg silicate | 1.25% |
| Carboxymethylcellulose (CMC), Na salt | 0.6% |
| Ethylenediaminetetraacetic acid, $Na_4$ salt | 0.2% |
| Remainder water to make up to | 100% |

Thus, this is a reduced-phosphate detergent, as encountered commercially after the second stage of the regulation on maximum phosphate content, of the German Detergent Law, came into force in January 1984.

Table 2 shows the increase in the reflectance of a polyester fabric and a polyester/cotton blend after the addition of 0.5%, based on the weight of the detergent used, of the novel products in comparison with the washing test without the addition of an antiredeposition agent and in comparison with the addition of an antiredeposition agent according to European Pat. No. 87,671.

TABLE 2

| | | % Reflectance | |
|---|---|---|---|
| | | PES | PES/C |
| | No addition | 41.1 | 56.0 |
| Comparative example | | | |
| 1 | VAc/VP/DEAEA copolymer* according to Example 8 of European Patent 87,671 | 56.8 | 61.6 |
| 2 | Graft copolymer 11 | 45.2 | 58.5 |
| 3 | Graft copolymer 12 | 52.2 | 58.0 |
| 4 | Graft copolymer 13 | 54.0 | 60.0 |
| 5 | Dispersed polyvinyl acetate (K value 42) | 48.8 | 56.5 |
| 6 | Polyethylene oxide (molecular weight 9000) | 42.2 | 56.2 |
| 7 | Graft copolymer 14 | 41.8 | 56.4 |
| Example | | | |
| 1 | Graft copolymer 1 | 58.4 | 58.5 |
| 2 | Graft copolymer 2 | 69.9 | 68.2 |
| 3 | Graft copolymer 3 | 71.1 | 69.1 |
| 4 | Graft copolymer 4 | 71.2 | 66.1 |
| 5 | Graft copolymer 5 | 71.4 | 66.5 |
| 6 | Graft copolymer 6 | 70.7 | 65.7 |
| 7 | Graft copolymer 7 | 69.6 | 65.3 |
| 8 | Graft copolymer 8 | 57.1 | 64.6 |
| 9 | Graft copolymer 9 | 68.3 | 65.3 |
| 10 | Graft copolymer 10 | 62.4 | 62.3 |

*VAc = vinyl acetate
VP = vinylpyrrolidone
DEAEA = diethylaminoethyl acrylate
PEG = polyethylene glycol
PES = polyester fabric
PES/C = polyester/cotton blend The table shows that, on the one hand, the activity decreases when the polyethylene glycol chosen as a starting material for the graft copolymer has a molecular weight of less than about 2000, while on the other hand maximum activity is achieved at a polyethylene glycol/vinyl acetate ratio of about 1:2 to 1:2.5. It can also be seen that the novel products are substantially superior to the vinyl acetate copolymers described in European Pat. No. 87,671. The table also shows that water-dispersed polyvinyl acetate alone and polyethylene glycol alone have virtually no antiredeposition action, and this is also true of a graft copolymer whose acetate groups have been completely hydrolyzed.

We claim:

1. A detergent comprising surfactants, builders, bleaches and conventional additives, which contains, as an added soil antiredeposition agent, from 0.1 to 3% by weight of a graft copolymer which is obtainable by grafting (a) a polyalkylene oxide having a number average molecular weight of from 2000 to 100,000 and based on ethylene oxide, propylene oxide and/or butylene oxide with (b) vinyl acetate in a weight ratio (a):(b) of from 1:0.2 to 1:10.

2. A detergent as claimed in claim 1, wherein the graft copolymer added as an antiredeposition agent is obtainable by grafting (a) a polyalkylene oxide having a number average molecular weight of from 4000 to 50,000 with (b) vinyl acetate in a weight ratio of from 1:0.5 to 1:6.

3. A detergent as claimed in claim 1, wherein the graft copolymer added as an antiredeposition agent has a K value of from 10 to 200 (determined according to H. Fikentscher in 1% strength by weight solution in ethyl acetate at 25° C.).

4. A detergent as claimed in claim 1, wherein the graft copolymer added as an antiredeposition agent is obtainable by grafting (a) a polyethylene oxide having a number average molecular weight of from 2000 to 50,000 with (b) vinyl acetate in a weight ratio of from 1:0.5 to 1:6 and has a K value of from 10 to 200, determined according to H. Fikentscher in 1% strength solution in ethyl acetate at 25° C.

5. A detergent as claimed in claim 1, wherein up to 15% of the acetate groups of the graft copolymer are hydrolyzed.

6. A detergent comprising as an added soil antiredeposition agent, from 0.1 to 3% by weight of a graft copolymer which is obtainable by grafting (a) a polyalkylene oxide having a number average molecular weight of from 2000 to 100,000 and based on ethylene oxide, propylene oxide and/or butylene oxide with (b) vinyl acetate in a weight ratio (a):(b) of from 1:0.2 to 1:10.

7. A detergent as claimed in claim 6, wherein the graft copolymer added as an antiredeposition agent is obtainable by grafting (a) a polyalkylene oxide having a number average molecular weight of from 4000 to 50,000 with (b) vinyl acetate in a weight ratio of from 1:0.5 to 1:6.

8. A detergent as claimed in claim 6, wherein the graft copolymer added as an antiredeposition agent has a K value of from 10 to 200 (determined according to H. Fikentscher in 1% strength by weight solution in ethyl acetate at 25° C.).

9. A detergent as claimed in claim 6, wherein the graft copolymer added as an antiredeposition agent is obtainable by grafting (a) a polyethylene oxide having a number average molecular weight of from 2000 to 50,000 with (b) vinyl acetate in a weight ratio of from 1:0.5 to 1:6 and has a K value of from 10 to 200, determined according to H. Fikentscher in 1% strength solution in ethyl acetate at 25° C.

10. A detergent as claimed in claim 6, wherein up to 15% of the acetate groups of the graft copolymer are hydrolyzed.

11. A process for soil antiredeposition during washing with detergents having a reduced phosphate content of less than 25% by weight of sodium triphosphate, which comprises using as a soil antiredeposition agent a graft copolymer which is obtainable by grafting (a) a polyalkylene oxide having a number average molecular weight of from 2,000 to 100,000 and based on ethylene oxide, propylene oxide and/or butylene oxide with (b) vinyl acetate in a weight ratio (a):(b) of from 1:0.2 to 1:10.

12. A process as claimed in claim 11, wherein the graft copolymer used as an antiredeposition agent is obtainable by grafting (a) a polyalkylene oxide having a number average molecular weight of from 4000 to 50,000 with (b) vinyl acetate in a weight ratio of from 1:0.5 to 1:6.

13. A process as claimed in claim 11, wherein the graft copolymer used as an antiredeposition agent has a K value of from 10 to 200 (determined according to H. Fikentscher in 1% strength by weight solution in ethyl acetate at 25° C.)

14. A process as claimed in claim 11, wherein the graft copolymer used as an antiredeposition agent is obtainable by grafting (a) a polyethylene oxide having a number average molecular weight of from 2000 to 50,000 with (b) vinyl acetate in a weight ratio of from 1:0.5 to 1:6 and has a K value of from 10 to 200, determined according to H. Fikentscher in 1% strength solution in ethyl acetate at 25° C.

15. A process as claimed in claim 11, wherein up to 15% of the acetate groups of the graft copolymer are hydrolyzed.

* * * * *